US011173079B2

(12) United States Patent
Moore

(10) Patent No.: US 11,173,079 B2
(45) Date of Patent: Nov. 16, 2021

(54) MODULAR POWER BASES FOR WHEELCHAIRS

(71) Applicant: Toyota Motor North America, Inc., Plano, TX (US)

(72) Inventor: Douglas A. Moore, Fairview, TX (US)

(73) Assignee: Toyota Motor North America, Inc., Plano, TX (US)

( * ) Notice: Subject to any disclaimer, the term of this patent is extended or adjusted under 35 U.S.C. 154(b) by 419 days.

(21) Appl. No.: 16/133,198

(22) Filed: Sep. 17, 2018

(65) Prior Publication Data

US 2020/0085654 A1 Mar. 19, 2020

(51) Int. Cl.

| | |
|---|---|
| ***A61G 5/06*** | (2006.01) |
| ***A61G 5/04*** | (2013.01) |
| *A61G 5/10* | (2006.01) |

(52) U.S. Cl.

CPC ..... *A61G 5/061* (2013.01); *A61G 5/047* (2013.01); *A61G 5/063* (2013.01); *A61G 5/068* (2013.01); *A61G 5/1059* (2013.01); *A61G 5/1089* (2016.11)

(58) Field of Classification Search

CPC ..... A61G 5/061; A61G 5/047; A61G 5/1089; A61G 5/063; A61G 5/068; A61G 5/1059; A61G 2203/36; A61G 2203/42; A61G 5/1078; A61G 5/06

See application file for complete search history.

(56) References Cited

U.S. PATENT DOCUMENTS

| | | | | |
|---|---|---|---|---|
| 5,964,473 | A | 10/1999 | Degonda et al. | |
| 5,975,225 | A * | 11/1999 | Kamen | B62K 11/007 180/7.1 |
| 6,206,119 | B1 | 3/2001 | Wu | |
| 6,341,784 | B1 | 1/2002 | Carstens | |
| 6,554,086 | B1 | 4/2003 | Goertzen et al. | |

(Continued)

FOREIGN PATENT DOCUMENTS

| | | | |
|---|---|---|---|
| JP | 2007186184 A | * | 7/2007 |
| JP | 2007186184 A | | 7/2007 |

(Continued)

OTHER PUBLICATIONS

"Curb Climbing Wheelchair" http://me.eng.stonybrook.edu/~seniordesign/project%202011/5%20Curb%20Climbing%20Wheelchair.htm; Accessed/Published Date: Apr. 16, 2018.

(Continued)

*Primary Examiner* — Minnah L Seoh
*Assistant Examiner* — Marlon A Arce
(74) *Attorney, Agent, or Firm* — Dinsmore & Shohl LLP

(57) ABSTRACT

A modular power base for a wheelchair, the modular power base includes a leg module. The leg module includes an upper leg portion comprising a distal end and a proximal end. The proximal end is configured to be detachably and rotatably coupled to a seat portion of the wheelchair. The leg module also includes a lower leg portion having a first end and a second end, the first end of the lower leg portion being rotatably coupled to the distal end of the upper leg portion. The leg module also includes a first wheel rotatably coupled to the distal end of the upper leg portion and to the first end of the lower leg portion and a second wheel rotatably coupled to the second end of the lower leg portion.

21 Claims, 11 Drawing Sheets

(56) References Cited

U.S. PATENT DOCUMENTS

| | | | | |
|---|---|---|---|---|
| 6,915,878 | B2 * | 7/2005 | Kamen | A61G 5/14 182/141 |
| 8,011,459 | B2 * | 9/2011 | Serai | B62K 11/007 180/8.2 |
| 8,170,781 | B2 * | 5/2012 | Fuwa | B62K 11/007 701/124 |
| 8,371,410 | B2 * | 2/2013 | Fuwa | B62D 63/00 180/218 |
| 8,374,774 | B2 * | 2/2013 | Doi | B60L 15/20 701/124 |
| 8,442,661 | B1 * | 5/2013 | Blackwell | G05D 1/0891 700/54 |
| 9,375,372 | B2 | 6/2016 | Hunziker | |
| 10,259,481 | B2 * | 4/2019 | Gerhardt | B62B 5/0083 |
| 2002/0121394 | A1 * | 9/2002 | Kamen | A61G 5/061 180/41 |
| 2010/0174476 | A1 | 7/2010 | Fuwa | |
| 2015/0374564 | A1 * | 12/2015 | Sutton | A61G 5/1075 280/657 |
| 2016/0151215 | A1 | 6/2016 | Golden, Jr. | |
| 2017/0172823 | A1 | 6/2017 | Ishikawa et al. | |
| 2018/0028380 | A1 | 2/2018 | Behrens | |

FOREIGN PATENT DOCUMENTS

| | | | |
|---|---|---|---|
| WO | 9623478 | A1 | 8/1996 |
| WO | 2017137967 | A1 | 8/2017 |
| WO | 2018002768 | A1 | 1/2018 |

OTHER PUBLICATIONS

Cheelcare, https://www.cheelcare.com/; Accessed/Published Sep. 17, 2018.

International Search Report and Written Opinion dated Nov. 4, 2019 for PCT/US2019/050323.

* cited by examiner

MODULAR POWER BASES FOR WHEELCHAIRS

TECHNICAL FIELD

The present specification generally relates to systems for powering wheelchairs and, more specifically, to modular power bases for wheelchairs.

BACKGROUND

Current wheelchairs may be limited to planar travel. If a wheelchair user wants to travel vertically, they must find a ramp because the wheelchair limits the user from overcoming discrete vertical obstacles, such as steps. Additionally, current wheelchairs cannot raise and lower a seat based on wheel movement of the chair. Moreover, the application of current wheelchair wheels does not extend beyond the scope of the chair itself meaning that a user gets no benefit from wheelchair wheels unless he or she is actually using the wheelchair. Accordingly, modular power bases for wheelchairs are desirable.

SUMMARY

In one embodiment, a modular power base for a wheelchair includes a leg module. The leg module includes an upper leg portion comprising a distal end and a proximal end. The proximal end is configured to be detachably and rotatably coupled to a seat portion of the wheelchair. The leg module also includes a lower leg portion having a first end and a second end, the first end of the lower leg portion being rotatably coupled to the distal end of the upper leg portion. The leg module also includes a first wheel rotatably coupled to the distal end of the upper leg portion and to the first end of the lower leg portion and a second wheel rotatably coupled to the second end of the lower leg portion.

In another embodiment, a wheelchair assembly includes a seat portion and a leg module detachably coupled to the seat portion. The leg module includes an upper leg portion comprising a distal end and a proximal end. The proximal end is configured to be detachably and rotatably couple to the seat portion. The leg module also includes a lower leg portion having a first end and a second end, the first end of the lower leg portion being rotatably coupled to the distal end of the upper leg portion. The leg module also includes a first wheel rotatably coupled to the distal end of the upper leg portion and to the first end of the lower leg portion and a second wheel rotatably coupled to the second end of the lower leg portion.

In yet another embodiment, a wheelchair assembly includes a seat portion, a first leg module detachably coupled to the seat portion, and a second leg module detachably coupled to the seat portion. Each of the first leg module and the second leg module includes an upper leg portion comprising a distal end and a proximal end. The proximal end is configured to detachably and rotatably couple to the seat portion. Each of the first leg module and the second leg module includes a lower leg portion having a first end and a second end, the first end of the lower leg portion is rotatably coupled to the distal end of the upper leg portion. A first wheel is rotatably coupled to the distal end of the upper leg portion and to the first end of the lower leg portion. A second wheel is rotatably coupled to the second end of the lower leg portion.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Wheelchair assemblies may include a modular power base including at least one leg module supporting and powering the wheelchair assembly. The leg module may be selectively attachable to the wheelchair assembly and adaptable for use in one or more systems and/or assemblies external to the wheelchair. The leg module may include at least one driven wheel and an electric motor configured to drive the driven wheel. The driven wheel(s) may be used to power the wheelchair assembly and may also be used to power the systems and/or assemblies external to the wheelchair assembly. One or more portions of the leg module may articulate with respect to a seat portion of the wheelchair assembly to balance and position the seat and/or to surmount environmental obstacles in a path of the wheelchair assembly. The articulable portions of the leg module may be articulated by one or more actuators. Leg modules as described herein may enhance the versatility and usability of wheelchair assemblies. For example, they may enable the wheelchair assembly to overcome obstacles in its path. Additionally, leg modules may have separate and external applications as systems and/or components that increase and/or enhance a user's mobility options.

Figure 1:
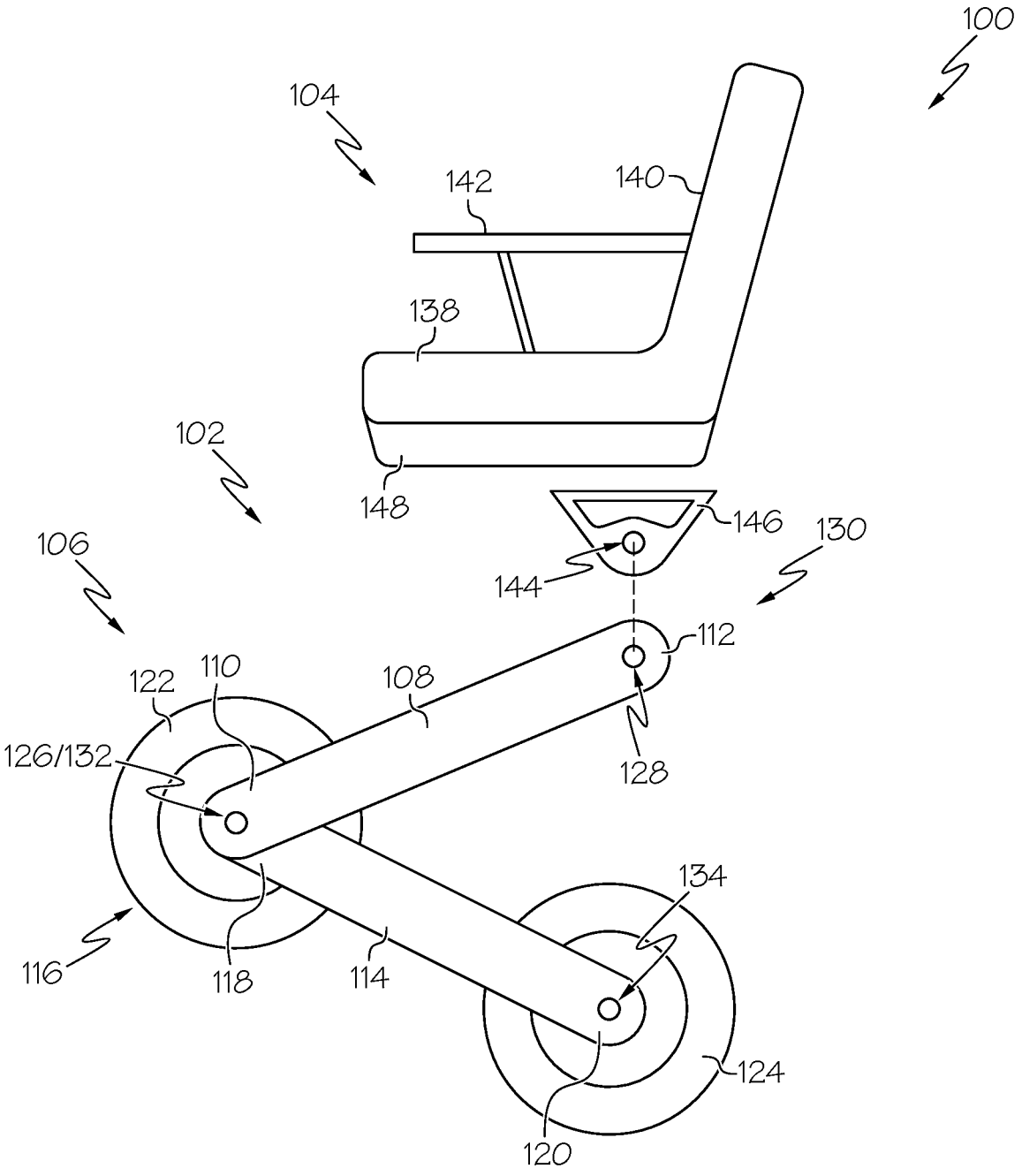
FIG. 1 depicts a schematic illustration of a wheelchair assembly including a modular power base and a leg module, according to one or more embodiments shown and described herein.
Figure 2:
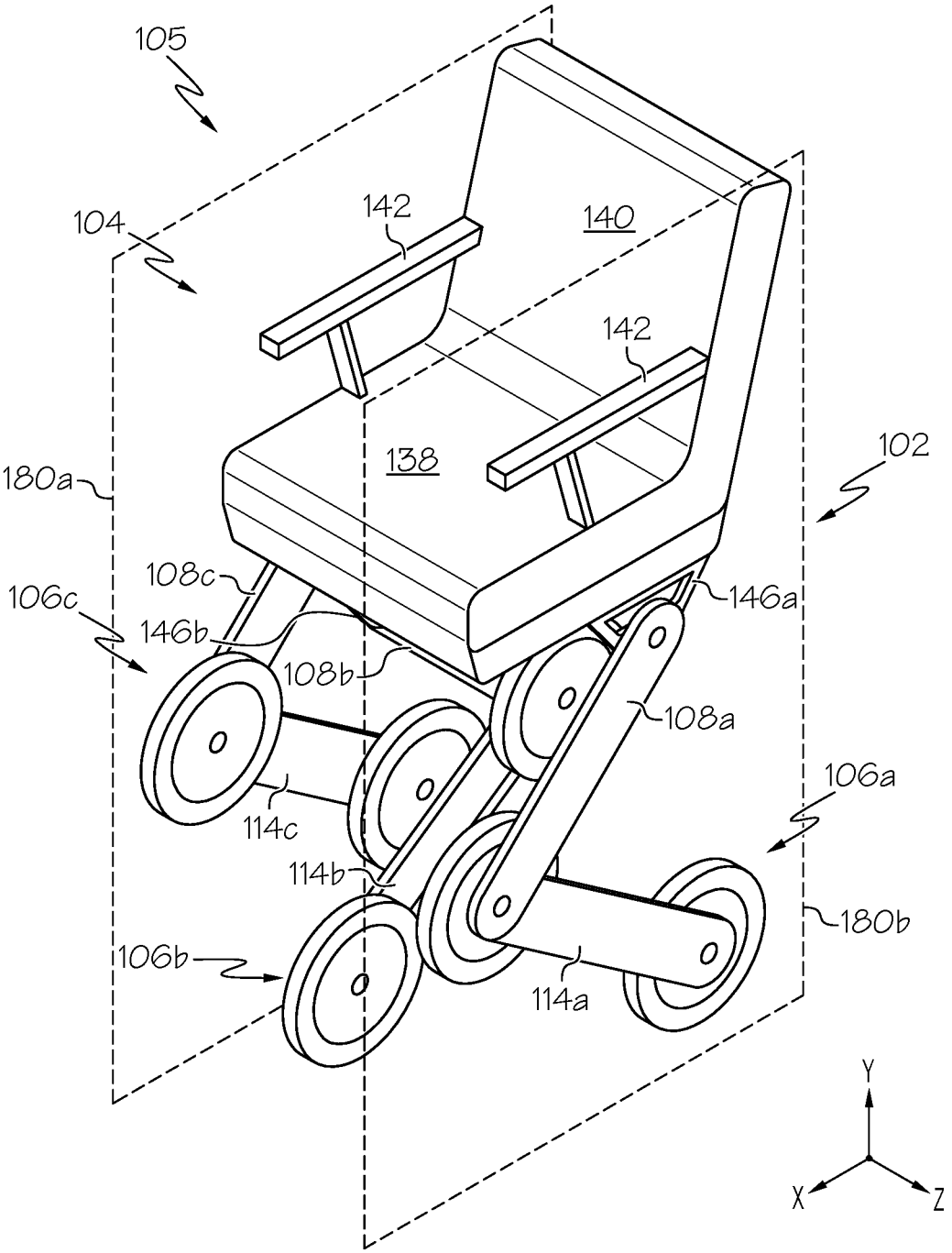
FIG. 2 depicts the wheelchair assembly including multiple leg modules, according to one or more embodiments shown and described herein.

Referring now to FIG. 1, an illustrative embodiment of a wheelchair assembly 100 including a modular power base 102 that may be used to support a seat portion 104 is shown. The wheelchair assembly 100 includes at least one leg module 106 including an upper leg portion 108 including a distal end 110 and a proximal end 112. The upper leg portion 108 may be rotatably coupled to a lower leg portion 114 and define a knee joint 116. The lower leg portion 114 includes a first end 118 and a second end 120. The leg module 106 may further include a first wheel 122 and a second wheel 124. The wheelchair assembly 100 may further include a seat 138, a backrest 140, and one or more armrests 142. FIG. 2 shows a wheelchair assembly 105 with three leg modules 106*a*, 106*b*, 106*c*. Each of the leg modules 106*a*, 106*b*, 106*c* includes the same components as the leg module 106 depicted in FIG. 1. The components of the leg modules 106*a*, 106*b*, 106*c* corresponding to the components of the leg module 106 are numbered the same with a, b, and c letters indicating the distinct components of the three separate leg modules 106*a*, 106*b*, 106*c*. For the purposes of the description, reference will be made to the leg module 106 in FIG. 1 without reference to any particular one of the multiple leg modules 106*a*, 106*b*, 106*c* unless specifically stated. Although the particular leg modules 106*a*, 106*b*, and 106*c* of FIG. 2 may be distinctly arranged, it is to be understood that each of the components of the leg module 106 described with respect to FIG. 1 are included in each of the leg modules 106*a*, 106*b*, and 106*c* of FIG. 2 unless specifically described otherwise.

Referring again to FIG. 1, the upper leg portion 108 generally includes an elongate bar extending between the distal end 110 and the proximal end 112. The upper leg portion 108 may include a distal aperture 126 positioned at the distal end 110 and a proximal aperture 128 positioned at the proximal end 112. The proximal end 112 is configured to be detachably and rotatably coupled to the seat portion 104. It is contemplated that the distal aperture 126 and the proximal aperture 128 may be placed closer or farther apart from one another in various embodiments. When assembled to the wheelchair assembly 100, the upper leg portion 108 may be rotatably coupled to the seat portion 104 at the proximal aperture 128 to form a hip joint 130. In some embodiments, the hip joint 130 may be formed between the proximal aperture 128 of the upper leg portion 108 and a frame aperture 144 of a frame member 146 that may be coupled to a bottom surface 148 of the seat portion 104 when the wheelchair assembly 100 is assembled.

As will be described in greater detail herein, the frame member 146 may be any structure configured to provide a location to couple the upper leg portion 108 to the seat portion 104. For example, and as shown, the frame member 146 may have the frame aperture 144, wherein a fastener may be passed through both the upper leg portion 108 and the frame member 146 to secure the frame member 146 and the upper leg portion 108 to one another. For example, and as described above, the frame member 146 may be coupled to the bottom surface 148 of the seat portion 104. Briefly referring to FIG. 4A, the wheelchair assembly 100 may include multiple frame members 146, for example, some embodiments may include a first frame member 146*a* and a second frame member 146*b*. That is, each leg module 106 may have a dedicated frame member 146 through which the leg module 106 may be coupled to the seat portion 104 of the wheelchair assembly 100. However, it is contemplated that a single frame member 146 may be used that may be similar or distinct from the frame member 146. Referring back to FIG. 1, the frame member 146 may be mechanically coupled to a bottom surface 148 of the seat portion 104 (e.g., through fasteners, adhesives, welding, brazing, and the like). The various frame members may be positioned on the bottom surface 148 of the seat portion 104 such that the leg modules 106 do not extend beyond and increase a width of the wheelchair assembly 100 defined by the seat portion 104.

Still referring to FIG. 1, the upper leg portion 108 may be rotatably coupled to the lower leg portion 114 to define the knee joint 116. The lower leg portion 114 may generally include an elongate bar extending between the first end 118 and the second end 120. The lower leg portion 114 may include a first aperture 132 to facilitate coupling of the upper leg portion 108 to the lower leg portion 114. For example, the distal aperture 126 of the upper leg portion 108 and the first aperture 132 of the lower leg portion 114 may be aligned and a fastener may be passed through to rotatably couple the upper leg portion 108 to the lower leg portion 114 at the knee joint 116. The lower leg portion 114 may further include a second aperture 134. In some embodiments, the first aperture 132 and the second aperture 134 may be located at the first end 118 and the second end 120 respectively and as illustrated in the figures, but embodiments are not limited to this arrangement. It is contemplated that the first aperture 132 and the second aperture 134 may be located at any position along the length of the lower leg portion 114. In some embodiments, the upper leg portion 108 is coupled to the lower leg portion 114 at the first end 118, but it is contemplated that the upper leg portion 108 may couple to the lower leg portion 114 at any position along the length of the lower leg portion 114. Accordingly, the knee joint 116 may be positioned anywhere along the length of the lower leg portion 114 and the upper leg portion 108.

In some embodiments, the first wheel 122 is coupled to the lower leg portion 114 and to the upper leg portion 108 at the knee joint 116. In some embodiments, the second aperture 134 is located at the second end 120 and the second wheel 124 is coupled to the lower leg portion 114 at the second end 120, but it is contemplated that the second wheel 124 and/or the second aperture 134 may be located at any point along the length of the lower leg portion 114.

In the particular embodiment shown in FIG. 1, the upper leg portion 108 and the lower leg portion 114 are equal lengths. However, embodiments are contemplated in which the upper leg portion 108 and the lower leg portion 114 are different lengths. For example, embodiments are contemplated in which the upper leg portion 108 is longer than the lower leg portion 114 or the lower leg portion 114 is longer than the upper leg portion 108. Additionally, embodiments in which the lengths of the lower leg portions 114 and/or upper leg portions 108 of different leg modules 106 are different relative to one another are contemplated. With brief reference to FIG. 2, it is contemplated that the left upper leg portion 108*a* may be a different length than the middle upper leg portion 108*b*, which may be a different length than the right upper leg portion 108*c*. Further, it is contemplated that the left lower leg portion 114*a* may be a different length than the middle lower leg portion 114*b*, which may be a different length than the right lower leg portion 114*c*.

In the particular embodiment shown in FIG. 1, the motion of the upper leg portion 108 and the lower leg portion 114 may be in the same plane or in parallel planes. However, embodiments are contemplated in which the motion of the upper leg portion 108 and the lower leg portion 114 are in non-parallel planes. For example, in some embodiments, the upper leg portion 108 and/or the lower leg portion 114 can rotate in more than one radial direction at the hip joint 130 and/or the knee joint 116 (e.g., a ball-and-socket joint type at the hip joint 130 and/or knee joint 116). Briefly referring to the particular illustrated embodiment of FIG. 2, the leg modules 106*a*, 106*b*, 106*c* do not extend out from beneath the wheelchair assembly 100 (i.e., they do not extend outward of the parallel planes 180*a* and 180*b*), but embodiments are not limited to this configuration.

Figure 3:
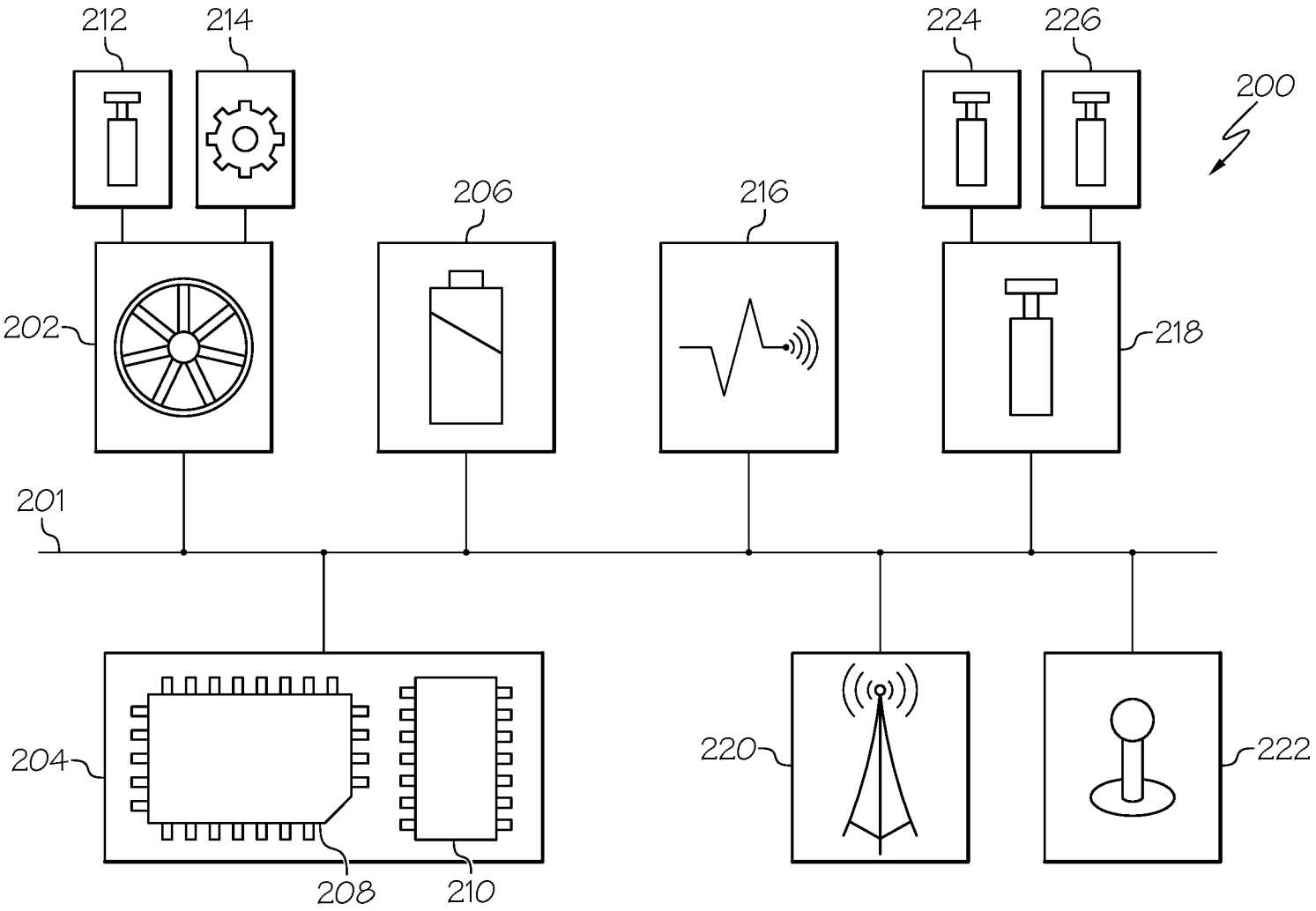
FIG. 3 depicts a schematic diagram of one or more electro-mechanical components of a modular power base, according to one or more embodiments shown and described herein.

Referring to FIGS. 1 and 3, the wheelchair assembly 100 may include an upper leg actuator 224 that may be configured to articulate the upper leg portion 108 with respect to the seat portion 104. In some embodiments, the upper leg actuator 224 is mechanically coupled to one or more of the upper leg portion 108, the frame member 146, and the seat portion 104. The upper leg actuator 224 (described in greater detail herein with respect to the schematic shown in FIG. 3) may be a servomotor, a linear actuator, a pneumatic or hydraulic actuator, a torsional motor, or other type of actuator configured to actuate the upper leg portion 108.

Still referring to FIGS. 1 and 3, the wheelchair assembly 100 may further include a lower leg actuator 226 configured to articulate the lower leg portion 114 with respect to the upper leg portion 108. In some embodiments, the lower leg actuator 226 is mechanically coupled to one or more of the upper leg portion 108 and the lower leg portion 114. The lower leg actuator 226 (described in greater detail herein with respect to the schematic shown in FIG. 3) may be a servomotor, a linear actuator, a pneumatic or hydraulic actuator, a torsional motor, or other type of actuator configured to actuate the lower leg portion 114 with respect to the upper leg portion 108.

Still referring to FIGS. 1 and 3, one or more of the first wheel 122 and the second wheel 124 may be driven. One or more drive motors 212 and gear boxes 214 may be used to power the first wheel 122 and/or the second wheel 124. The drive motors 212 and gear boxes 214 may form a drive assembly 202 and the drive assembly 202 may be communicatively coupled to a control and power system 200 including one or more motor controllers and may be electrically coupled to a power assembly 206 including a battery for supplying electrical power to the motors. The drive assembly 202, control unit 204, and power assembly 206 are described in greater detail herein. In some embodiments, one or more of the first wheel 122 and the second wheel 124 may be an omni-directional wheel as described in U.S. Pat. No. 8,418,705 "Robotic Cane Devices," which is herein incorporated by reference in its entirety.

Still referring to FIGS. 1 and 3, the modular power base 102 for the wheelchair assembly 100 may include a control and power system 200. In some embodiments, each leg module 106 may include its own separate control and power system 200, but it is to be understood that one or more of the leg modules 106 of the modular power base 102 may include a different system that controls and powers the leg module 106 or may not include any system for controlling and/or powering the leg module 106 (e.g., in leg modules 106 that are slaves of a master leg module, a master wheelchair controller, etc.).

Referring to FIG. 3, the control and power system 200 may generally include a drive assembly 202, a control unit 204, a power assembly 206, a sensor unit 216 for sensing one or more external objects and/or a posture of one or more components, an actuator control unit 218, and network interface hardware 220 that are communicatively coupled to a communication path 201. The control and power system 200 may further include a user input module 222 for inputting one or more user inputs to affect the control and power system 200. The control unit 204 may include a processor 208 and a memory module 210 that stores a non-transitory processor readable instruction set that includes one or more instructions as will be described in greater detail herein. The drive assembly 202 may include one or more drive motors 212, and gear boxes 214. The network interface hardware 220 may communicatively couple the control and power system 200 to external systems.

The communication path 201 may be formed from any medium that is capable of transmitting a signal such as, for example, conductive wires, conductive traces, optical waveguides, or the like. The communication path 201 may also refer to the expanse in which electromagnetic radiation and their corresponding electromagnetic waves traverses. Moreover, the communication path 201 may be formed from a combination of mediums capable of transmitting signals. In one embodiment, the communication path 201 includes a combination of conductive traces, conductive wires, connectors, and buses that cooperate to permit the transmission of electrical data signals to components such as processors, memories, sensors, input devices, output devices, and communication devices. Accordingly, the communication path 201 may include a bus. Additionally, it is noted that the term "signal" means a waveform (e.g., electrical, optical, magnetic, mechanical or electromagnetic), such as DC, AC, sinusoidal-wave, triangular-wave, square-wave, vibration, and the like, capable of traveling through a medium. The communication path 201 communicatively couples the various components of the control and power system 200. As used herein, the term "communicatively coupled" means that coupled components are capable of exchanging signals with one another such as, for example, electrical signals via conductive medium, electromagnetic signals via air, optical signals via optical waveguides, and the like.

In some embodiments, the drive assembly 202 may be electrically and communicatively coupled to the communication path 201. The drive assembly 202 may include the drive motor 212. The drive motor 212 may be any typical electronic motor, for example, a six-pole electric motor. The drive motor 212 may be controlled by a motor controller that selectively applies power to the drive motor 212. Briefly referring to FIGS. 2 and 3, each of the first wheel 122 and the second wheel 124 may be driven by a separate drive motor, such as the drive motor 212. Additionally, the gear boxes 214 may include one or more gears and may translate the rotational motion of the drive motor 212 to rotational motion of the first wheel 122 and/or the second wheel 124. The first wheel 122 and the second wheel 124 may each be configured to actuate separately of one another, enabling the first wheel 122 and the second wheel 124 to move the leg module 106 such that the leg module 106 can move up and down vertical obstacles as will be described in greater detail herein.

Referring to FIG. 3, the control unit 204 may be any device or combination of components including one or more processors 208 and memory modules 210 that contain one or more non-transitory processor-readable instruction sets. Accordingly, the control unit 204 may include an electric controller, an integrated circuit, a microchip, a computer, or any other computing device. While the control unit 204 depicted in FIG. 3 includes a single processor 208, other embodiments may include more than one processor.

The memory module 210 of the control unit 204 may include RAM, ROM, flash memories, hard drives, or any non-transitory memory device capable of storing processor-readable instructions such that the processor-readable instructions can be accessed and executed. The processor-readable instruction set may include logic or algorithm(s) written in any programming language of any generation (e.g., 1GL, 2GL, 3GL, 4GL, or 5GL) such as, for example, machine language that may be directly executed by the control unit 204, or assembly language, object-oriented programming (OOP), scripting languages, microcode, etc., that may be compiled or assembled into machine readable instructions and stored in the memory module 210. Alternatively, the machine-readable instruction set may be written in a hardware description language (HDL), such as logic implemented via either a field-programmable gate array (FPGA) configuration or an application-specific integrated circuit (ASIC), or their equivalents. Accordingly, the functionality described herein may be implemented in any conventional computer programming language, as pre-programmed hardware elements, or as a combination of hardware and software components. While the embodiment depicted in FIG. 3 includes a control unit 204 with a single memory module 210, other embodiments may include more than one memory module.

Embodiments of the control and power system 200 may include the power assembly 206. The power assembly 206 may include a DC power source for supplying electric power to the control and power system 200 and its components. For example, the power assembly 206 may supply power to the modular power base 102 of FIG. 1. Still referring to FIG. 3, the power assembly 206 may include one or more devices configured to plug the power assembly 206 into a standard 110 V AC wall socket, for example, a wall socket in a typical American home in order to charge the power assembly 206. In some embodiments, the power assembly 206 may be configured with one or more batteries, such as a Li-ion battery, such that when the power assembly 206 is plugged into a wall, the power assembly 206 can store power to provide to one or more components of the control and power system 200. Briefly referring to both FIGS. 1 and 3, the power assembly 206 may electrically couple with a battery bank that may be in the seat portion 104 or another portion of the wheelchair assembly 100. The volume of the seat portion 104 may be greater than a volume of the leg module 106, and this added volume may be utilized to house a battery with a greater capacity than can fit in the leg module 106 or other smaller portions of the wheelchair assembly 100. In some embodiments, the leg module 106 may include its own battery that is used when the leg module 106 is disconnected from the wheelchair assembly 100.

Referring again to FIG. 3, the network interface hardware 220 may be any device capable of transmitting and/or receiving data via a network. Accordingly, network interface hardware 220 can include a communication transceiver for transmitting and/or receiving any wireless communication. For example, the network interface hardware 220 may include an antenna, Wi-Fi card, WiMax card, mobile communications hardware, near-field communication hardware, satellite communication hardware and/or any wireless hardware for communicating with other networks and/or devices (e.g., hardware for communicating via a Bluetooth or 5G connection). In one embodiment, network interface hardware 220 includes hardware configured to operate in accordance with the Bluetooth wireless communication protocol. In another embodiment, network interface hardware 220 may include a Bluetooth send/receive module for transmitting and receiving Bluetooth communications to/from a network. In some embodiments, the network interface hardware 220 may allow the various components of the wheelchair assembly 100 to communicate with one another and/or with external devices. For example, various electronic components of the leg modules 106 may be communicatively coupled to the control and power system 200 over the communication path 201.

The sensor unit 216 may include one or more sensors configured to output a signal indicative of at least one of an environmental condition or a posture of each of the leg modules 106. In some embodiments, an environmental condition may include the presence of an obstacle (e.g., stairs, an uneven surface, etc. in the path of the leg module 106). The sensor unit 216 may generate a signal based on the presence of an obstacle that causes the wheels and/or the leg portions to actuate (i.e., move) in response to the signal. Accordingly, the sensors may include one or more proximity sensors, touch sensors, cameras, and/other sensors for sensing the environment. In one particular embodiment, the sensors include a proximity sensor that is configured to emit a signal in the vicinity of the control and power system 200 and receive a signal that reflects from an environmental obstacle. For example, the sensors may include a LIDAR, LADAR, radar, sonar sensor, and/or laser scanners. In some embodiments, the sensor unit 216 may include a sensor that is configured to determine how fast an external object is approaching based on a change in relative speed between the external object and the wheelchair assembly 100. For example, the sensor unit 216 may include a Doppler effect sensor. Additionally, the sensor unit 216 may include one or more gyroscopes, accelerometers, angle sensors, torque sensors, and/or other sensors for tracking the posture and motion of the wheelchair assembly 100. The sensor unit 216 may be configured to detect an orientation of the wheelchair assembly 100 and/or one or more components thereof. For example, the sensor unit 216 may be configured to sense a level condition of the seat portion 104 in order to maintain the seat portion 104 level with respect to ground to keep an occupant of the seat portion 104 balanced.

The actuator control unit 218 may control one or more actuators. For example, with reference to FIGS. 2 and 3, the actuator control unit 218 may control an actuator for actuating the upper leg portion 108 to rotate the upper leg portion 108 with respect to the seat portion 104. The actuator control unit 218 may also control an actuator for actuating the lower leg portion 114 to rotate with respect to the upper leg portion 108. The upper leg portion 108 and the lower leg portion 114 may be actuated independently of one another. The upper leg portion 108 and the lower leg portion 114 may be actuated, for example, to overcome obstacles, to balance the seat portion 104, or for other reasons as will be described in greater detail herein.

Communicatively coupled to the control and power system 200 over the communication path 201 is the user input module 222. The user input module 222 may include tactile input hardware (e.g., joystick, knob, lever, button, etc.) that allows an operator to input commands into the control and power system 200 to operate one or more of the actuators and/or motors that control the various leg modules and wheels of the wheelchair assembly 100. In some embodiments, a joystick or other type of mechanical input device is communicatively coupled to the control and power system 200 such that when the joystick or other input device is activated (i.e., touched, moved, etc.), the one or more processors 208 of the control unit 204 execute logic stored on the one or more memory modules 210 to activate the actuators and/or motors.

The control and power system 200 may be communicatively coupled to one or more actuators for actuating the various components of the leg modules 106 over the communication path 201. For example, the control and power system 200 may be communicatively coupled to an upper leg actuator 224 and a lower leg actuator 226. One or more of the upper leg actuator 224 and the lower leg actuator 226 may be configured to move one or more of the lower leg portion 114 and the upper leg portion 108. For example, the upper leg actuator 224 may be configured to move the upper leg portion 108 about the hip joint 130 with respect to the seat portion 104. The lower leg actuator 226 may be configured to move the lower leg portion 114 about the knee joint 116 with respect to the upper leg portion 108. The upper leg actuator 224 and the lower leg actuator 226 may be communicatively coupled to the one or more processors 208, such that the one or more processors 208 execute logic stored in the one or more memory modules 210 to move the leg module 106 as described above. The upper leg actuator 224 and/or the lower leg actuator 226 may be DC motor, a stepper motor, or any other actuator as described herein that is capable of moving the upper leg portion 108 and/or the lower leg portion 114.

Figure 4C:
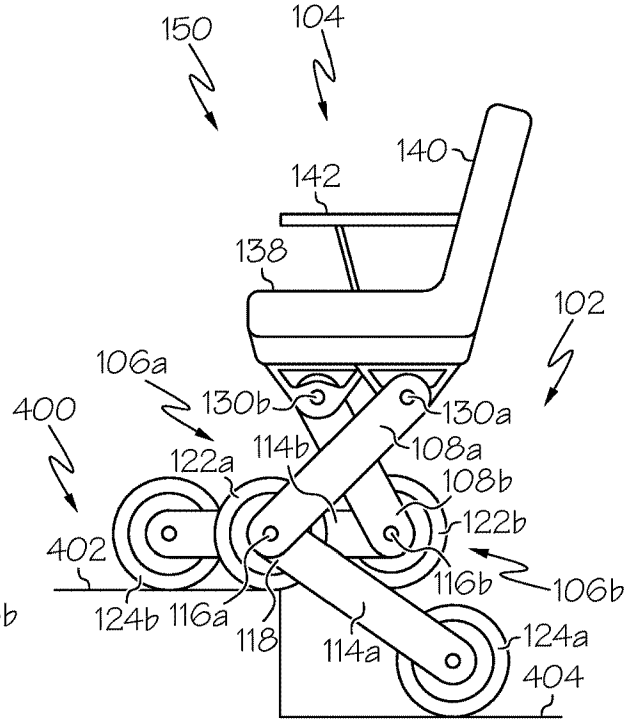
FIG. 4C depicts the wheelchair assembly of FIG. 4A with a middle leg module on an obstacle, according to one or more embodiments shown and described herein.
Figure 4B:
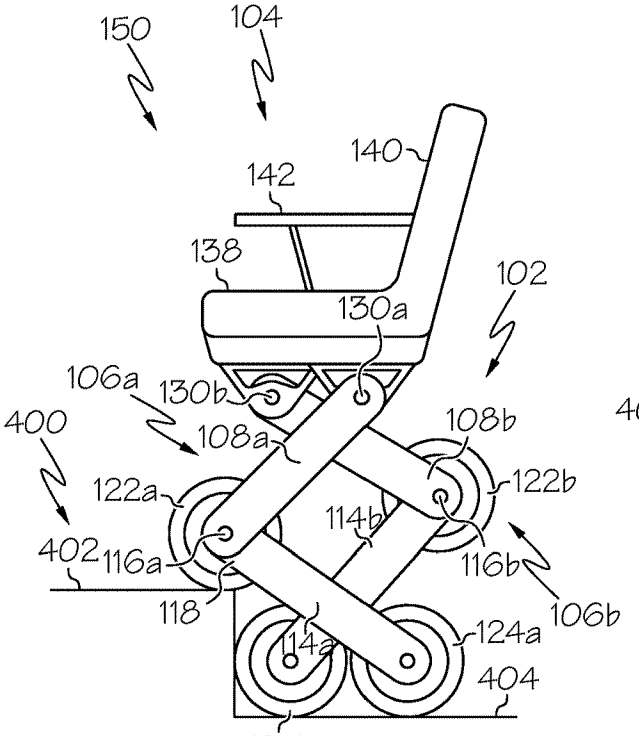
FIG. 4B depicts the wheelchair assembly climbing the obstacle of FIG. 4A, according to one or more embodiments shown and described herein.
Figure 4A:
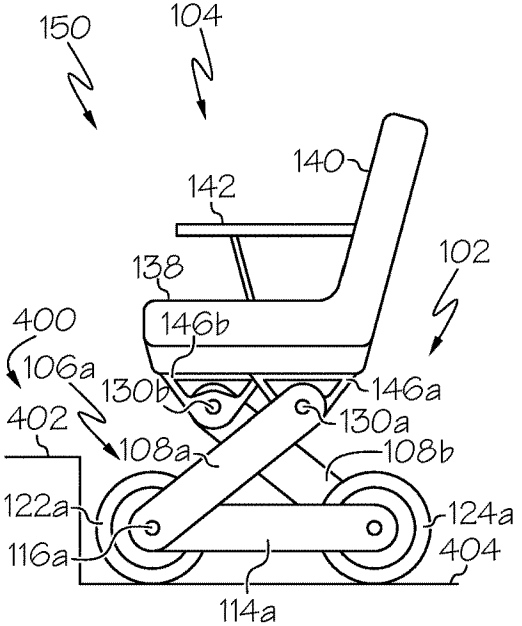
FIG. 4A depicts the wheelchair assembly approaching an obstacle, according to one or more embodiments shown and described herein.

The wheelchair assembly 105 of FIG. 2 and the wheelchair assembly 150 of FIGS. 4A-4C may include a similarly configured control and power system 200.

FIGS. 4A and 4B show a wheelchair assembly 150 approaching an obstacle 400 and FIG. 4C shows the wheelchair assembly 150 climbing the obstacle 400. With respect to FIGS. 4A, 4B, and 4C where a particular one of the multiple leg modules 106 is referred to, a letter designator is added to the numerical designator (i.e., 106*a*—left leg module, 106*b*—middle leg module) or the component part thereof (e.g., the left upper leg portion 108*a*, etc.). Where no letter is added to the numerical designator, it is to be understood that the designator refers to the group of leg modules or component parts thereof.

The obstacle 400 may be a vertical obstacle and may require actuation of one or more components of the modular power base 102 to overcome. The obstacle 400 may span an entire width between the left side and the right side of the wheelchair assembly 150 and require all of the leg modules 106 to actuate or may span only a portion of the width between the leg modules 106 and may require fewer than all of the leg modules 106 to actuate to overcome the obstacle 400 and/or balance the seat portion 104. The obstacle 400 shown in FIGS. 4A, 4B, and 4C is a step that spans the entire width of the wheelchair assembly 150, but other obstacles are contemplated. Non-limiting examples of obstacles generally include bumps, dips, speed bumps, ledges, cracks, uneven surfaces, sloped surfaces, etc.

As shown in FIG. 4A, the modular power base 102 is in a compact or typical driving configuration, wherein the wheelchair assembly 150 is moving over an even surface such as the floor 404. The motion of the leg modules 106 is described herein with respect to the left leg module 106*a* and the middle leg module 106*b*, but it is to be understood that a right leg module (106*c* in FIG. 2) may mirror the movement and actions of the left leg module 106*a*. In the compact configuration, the left leg module 106*a* and the middle leg module 106*b* are bent at the left knee joint 116*a* and the middle knee joint 116*b* and the left lower leg portion 114*a* and the middle lower leg portion 114*b* are generally parallel with a floor 404, although this is not necessary. The wheelchair assembly 150 approaches the obstacle 400 and when the obstacle 400 is within detection range of the one or more sensors in the sensor unit 216 (FIG. 3), the sensors sense the obstacle 400 and output a signal indicative of the obstacle 400. The leg modules 106 propel the wheelchair assembly 150 forward with the drive motors (such as the drive motors 212 of FIG. 3) coupled to one or more of the first wheel 122 and the second wheel 124. The drive motors 212 may propel the wheelchair assembly 150 until the first wheel 122 is in contact with the obstacle 400. The upper leg actuator 224 of the left leg module 106*a* may actuate to rotate the left upper leg portion 108*a* (in a counter-clockwise direction in the particular illustrative embodiment of FIG. 4A) until the left first wheel 122*a* is above the obstacle 400. The left second wheel 124*a* of the left leg module 106*a* may rotate freely and/or be actuated as the left upper leg portion 108*a* rotates about the left hip joint 130*a*.

Once the left first wheel 122*a* is on the obstacle 400 as shown in FIG. 4B, the middle second wheel 124*b* of the middle leg module 106*b* may be placed on the obstacle 400. Referring to FIG. 4C, the middle leg module 106*b* may actuate at the middle hip joint 130*b* and/or the middle knee joint 116*b* to raise the middle leg module 106*b* into position. The middle leg module 106*b* may rise until the middle second wheel 124*b* is on the obstacle 400. At this point, the wheelchair assembly 150 has three wheels on the obstacle 400 (i.e., the left first wheel 122*a* and the right first wheel (not shown) and the middle second wheel 124*b*) and two wheels on the floor 404 (i.e., the left second wheel 124*a* and the right second wheel (not shown)).

Because the middle second wheel 124*b* is a third point of contact on the obstacle 400, the wheelchair assembly 150 maintains three points of contact with the obstacle 400 as the left first wheel 122*a* and the right first wheel 122*c* move forward and the left second wheel 124*a* and the right second wheel 124*c* are lifted from the floor 404.

Accordingly, the wheelchair assembly 150 maintains sufficient points of contact with the ground or objects or obstacles that are coupled to the ground to maintain balance. Once the wheelchair assembly 150 is balanced with three wheels on the obstacle 400 and two wheels on the floor 404, the modular power base 102 may move the wheelchair assembly 150 forward until the wheels remaining on the floor 404 can be lifted and moved onto the obstacle 400. While the particular embodiment shown in FIGS. 4A-4C depicts a wheelchair assembly 150 with three leg modules 106 including a middle leg module 106*b*, it is contemplated that in some embodiments there may be no middle leg module 106*b* and that the wheelchair assembly 150 may balance itself on only two leg modules, for example, embodiments in which the wheelchair assembly 150 has only a left leg module 106*a* and a right leg module 106*c*.

Other functionality and motion of the wheelchair assembly 150 is considered. For example, with reference to FIG. 11, in some embodiments, the modular power base 102 may control the wheelchair assembly 150 to assist a user to get in or out of the seat portion 104. The left leg module 106*a* may bend at the left hip joint 130*a* and the left knee joint 116*a* and at the middle hip joint 130*b* and at the middle knee joint 116*b* to tip the seat portion 104 forward to lower the seat portion 104 such that a user can simply place his or her body in the seat 138 without needing to climb in or jump out of the seat 138. In some embodiments, the leg modules 106 may bend such that the seat 138 is positioned at the correct height in the vertical (+/−y) direction based on the height or preference of the user. The leg modules 106 may move with the user as the user enters or exits the seat 138, keeping the user balanced during the entry or exit. In some embodiments, the sensor unit 216 (FIG. 3) includes one or more sensors for sensing the size and weight of a user (e.g., a camera and/or a scale) and can determine the appropriate pose for comfortably seating a user or for assisting a user to enter or exit the wheelchair assembly 150.

Figure 11:
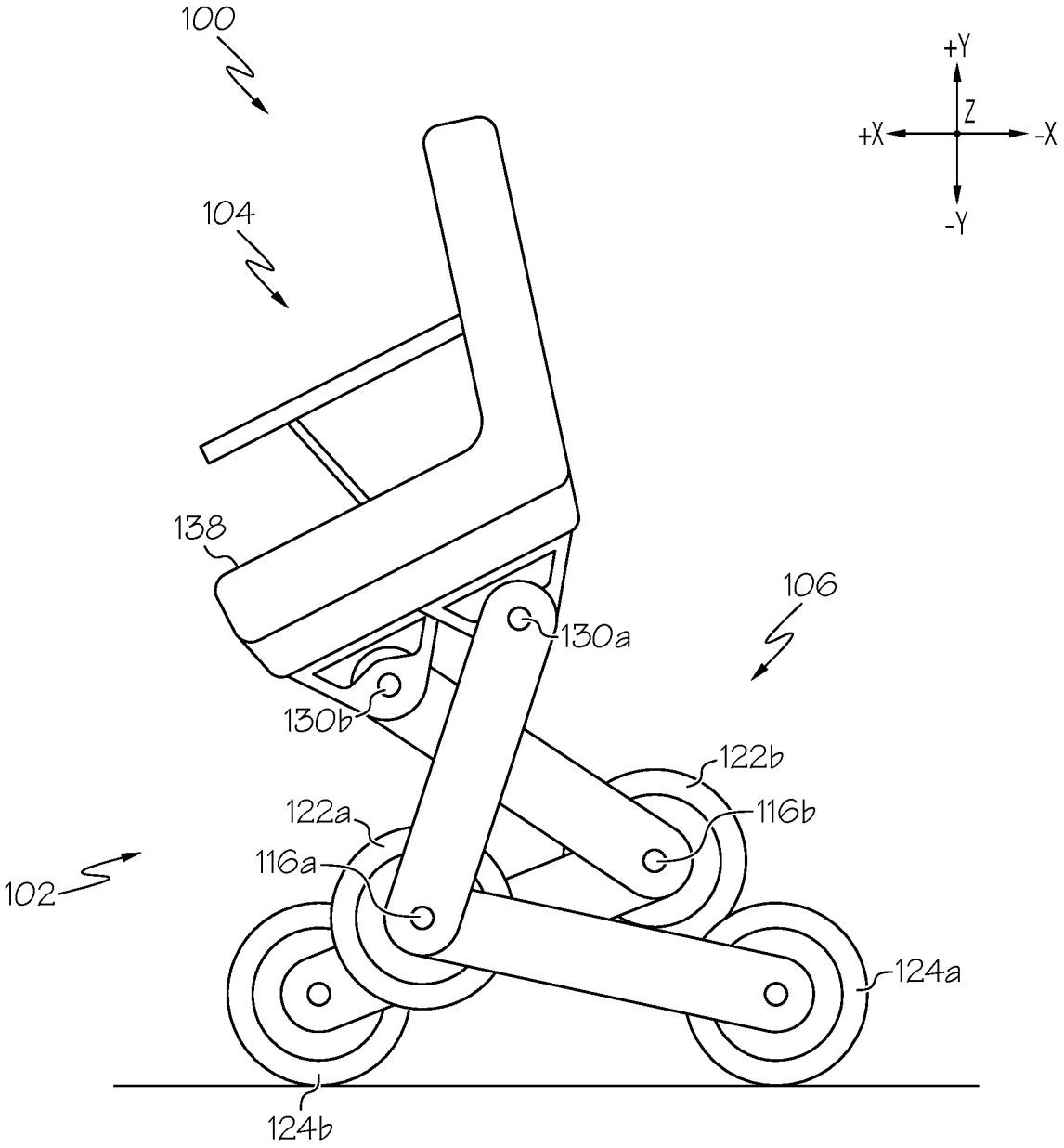
FIG. 11 depicts the wheelchair assembly of FIG. 4A bending such that a user can conveniently enter or exit a seat portion of the wheelchair assembly, according to one or more embodiments shown and described herein.

Referring to FIGS. 11 and 3, in some embodiments, the memory module 210 may store one or more setpoints or user preferences for entry and or exit of a user that may be automatically input based on a signal from the sensor unit 216 and or based on a user input. For example, the height of a user may be determined by one of the sensors of the sensor unit 216 (e.g., a camera or a LIDAR sensor). The height of the user's legs, abdomen, torso, and head (i.e., skeletal setpoints) may be stored in the memory module 210. The control and power system 200 may be configured to use the skeletal setpoints to automatically configure the leg modules 106 for the correct pose and height to help the user enter, exit, or sit comfortably in the seat 138.

Figure 5:
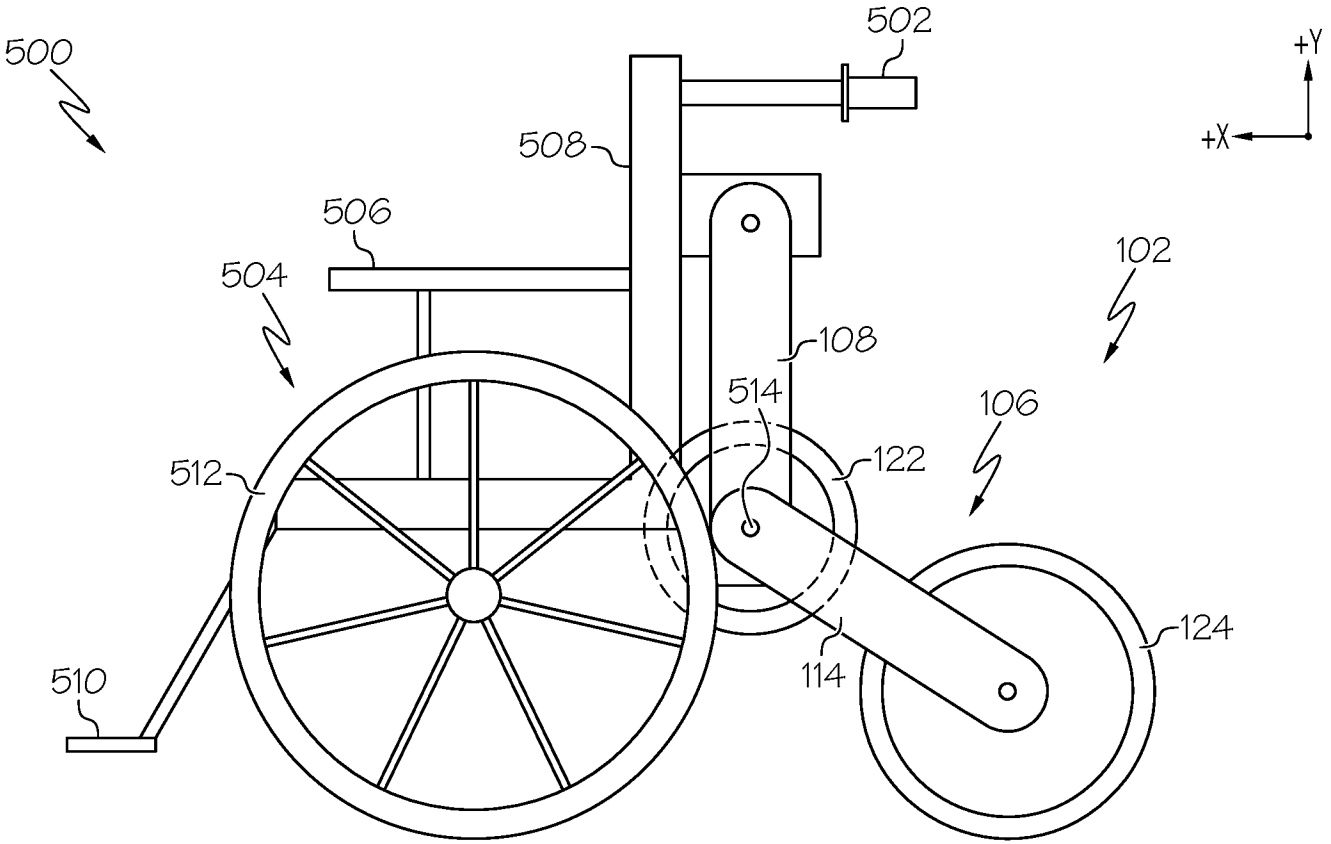
FIG. 5 depicts a standard wheelchair adapted for use with a leg module, according to one or more embodiments shown and described herein.

Referring now to FIG. 5, one or more of the leg modules 106 may be fitted to a standard wheelchair 500 to configure the standard wheelchair 500 for leg module-assisted propulsion. The standard wheelchair 500 may include handlebars 502, a seat 504, an armrest 506, a backrest 508, a leg support 510, and a base wheel 512. One or more portions of the leg module 106 may be fitted to the standard wheelchair 500 to selectively move the standard wheelchair 500 forward and backward without the need for human assistance.

As shown in FIG. 5, the leg module 106 includes the upper leg portion 108 and a wheel. The wheel shown in FIG. 5 is the first wheel 122, however, it is to be understood that the first wheel 122 and/or the second wheel 124 could be adapted to power the standard wheelchair 500. The upper leg portion 108 may be coupled to the standard wheelchair 500 at a distal end 110 (see FIG. 1) and/or a proximal end 112 (see FIG. 1) of the upper leg portion 108. In some embodiments, the upper leg portion 108 may be rotatably coupled to the standard wheelchair 500 at a pivot point 514 such that it can maintain contact with the ground as the wheelchair 500 moves from place to place. While the illustrated embodiment depicts the pivot point 514 at the rear of the seat 504, it is contemplated that the pivot point 514 may be at the front of the seat 504 or at some other location on the standard wheelchair 500 such that the seat 504 is balanced. The first wheel 122 is driven by a drive motor, for example, the drive motor 212 described in FIG. 3 above. Still referring to FIG. 5, it is contemplated that other portions and/or configurations of one or more leg modules 106 may be fitted to the standard wheelchair 500. For example, the standard wheelchair 500 may be fitted with multiple upper leg portions 108 and/or multiple lower leg portions 114, and other combinations of the two. A user of the standard wheelchair 500 may selectively actuate a drive motor such as the drive motor 212 of FIG. 3, to turn the second wheel 124 to propel the standard wheelchair 500 forward and/or backward.

Figure 6:
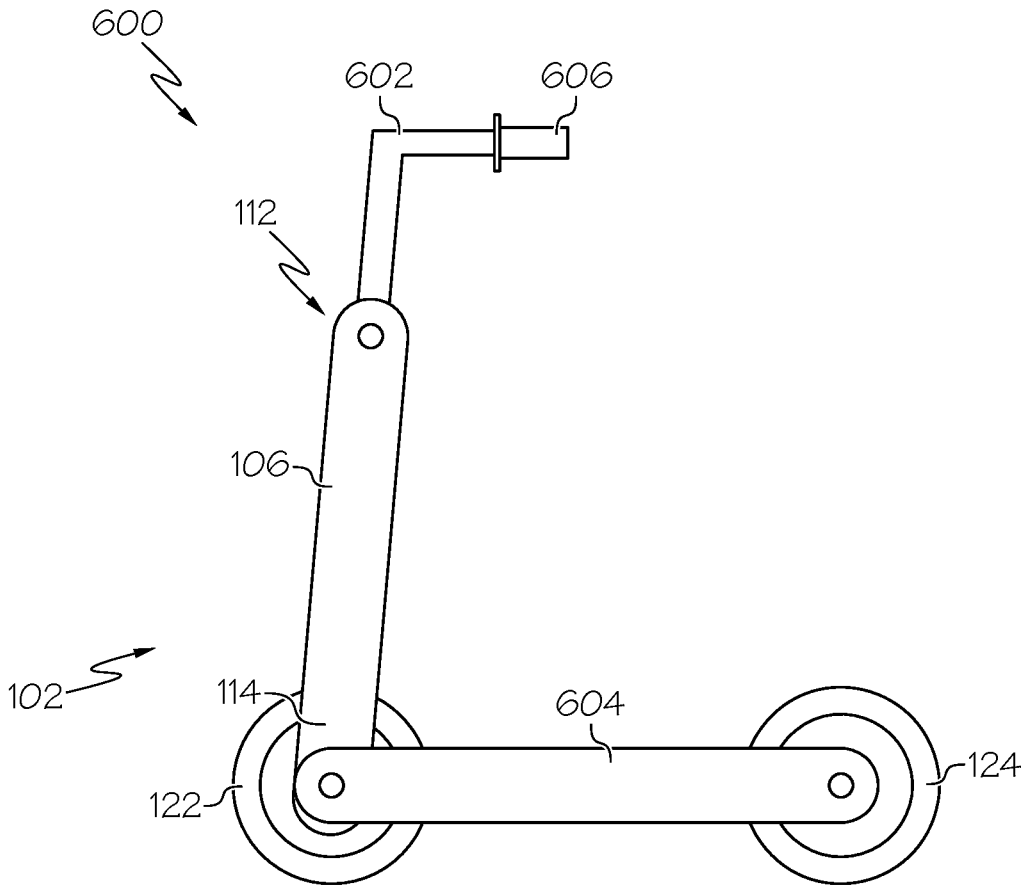
FIG. 6 depicts a leg module adapted for use as a scooter, according to one or more embodiments shown and described herein.

FIG. 6 depicts the leg module 106 in a scooter configuration. A scooter 600 includes handlebars 602 and a foot portion 604. The handlebars 602 may be selectively mechanically coupled to the proximal end 112 of the leg module 106. That is a user of the scooter 600 may remove the handlebars 602 from the leg module 106 and replace the handlebars 602 on the leg module 106 at will. The handlebars 602 may include a grip portion 606. The foot portion 604 may provide an area for a user of the scooter 600 to place his or her foot while standing on the scooter 600. In some embodiments, the foot portion 604 is integrated with the lower leg portion 114. For example, the foot portion 604 may be an integral part or portion of the lower leg portion 114 that is permanently coupled to the lower leg portion 114. In other embodiments, the foot portion 604 may be separable and distinct from the lower leg portion 114. One or more of the first wheel 122 and the second wheel 124 may be driven in the scooter configuration to move the user forward or backward.

In some embodiments, control of the scooter 600 may be located on the handlebars 602 allowing the user to control the scooter 600 while holding onto the handlebars 602. For example, the grip portion 606 may be configured with one or more controls for affecting the motion of the scooter 600. Accordingly, the scooter 600 may include an electrical or communicative connection between the handlebars 602 and the leg module 106 that may send and/or receive one or more signals between the scooter controls and the first wheel 122 and/or the second wheel 124. In some embodiments, only the first wheel 122 or the second wheel 124 is a driven wheel. However, it is contemplated that both the first wheel 122 and the second wheel 124 may be driven wheels.

In some embodiments, the scooter 600 may include one or more steering linkages connecting the handlebars 602 with the first wheel 122. The handlebars 602 may be gripped and manipulated to steer the scooter 600. In other embodiments, the scooter 600 is not steerable, for example, embodiments in which there is no steering linkage between the handlebars 602 and the first wheel 122.

Figure 7:
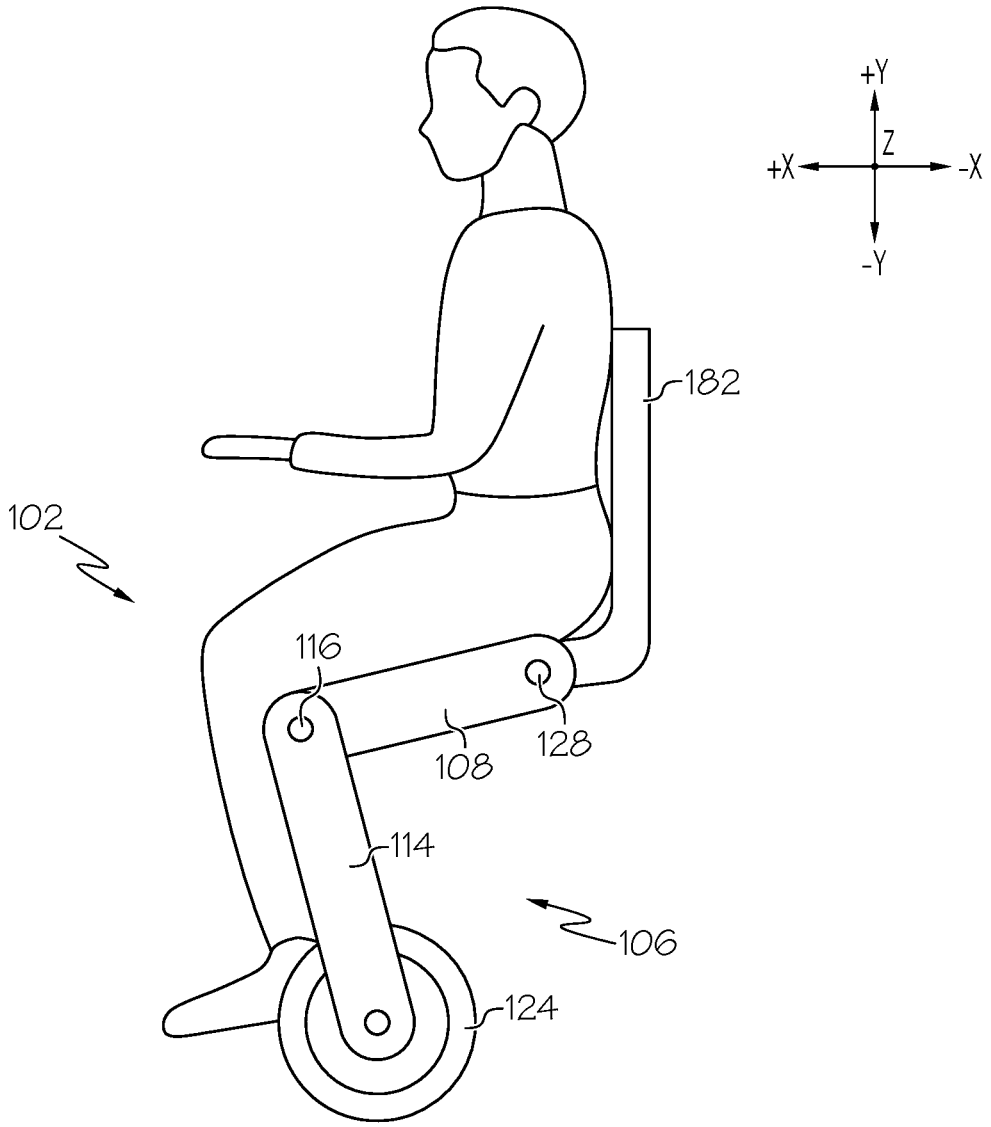
FIG. 7 depicts a leg module adapted for use as an exoskeletal adaptation of the leg module of the wheelchair assembly, according to one or more embodiments shown and described herein.

Referring now to FIG. 7, another embodiment of an application of the modular power base 102 is shown. The leg module 106 is coupled to an exoskeletal frame 182 at the proximal aperture 128. In the embodiment shown, the exoskeletal frame 182 supports a user's skeletal structure (i.e., body). The modular power base 102 is used to assist the user's movement. The second wheel 124 may be an omnidirectional wheel as described herein. The exoskeletal frame 182 may be balanced by the modular power base 102 which may include a balance control sensor that determines an orientation and movement of the exoskeletal frame 182. The sensor unit 216 may include the balance control sensor and the balance control sensor may include one or more gyroscope and/or accelerometer devices capable of determining an orientation of the modular power base 102 and/or the exoskeletal frame 182. Additionally, the balance control sensor may determine a velocity and acceleration of the exoskeletal frame 182. In some embodiments, a user may control the velocity and acceleration of the exoskeletal frame 182 by leaning forward or backward on the exoskeletal frame 182 which may cause the balance control sensor to develop a balance signal, causing the second wheel 124 to move to balance the user and the exoskeletal frame 182.

Figure 8C:
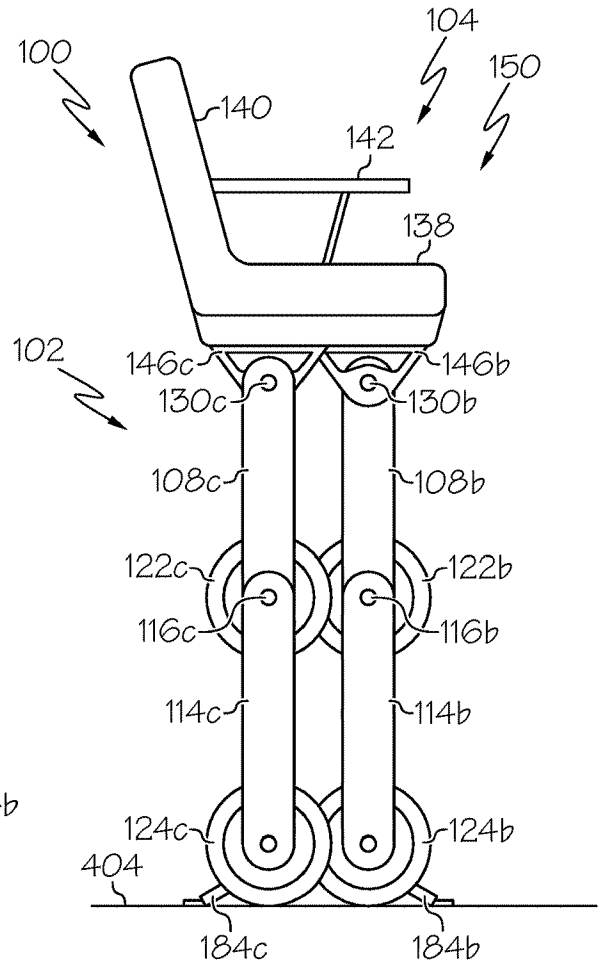
FIG. 8C depicts the wheelchair assembly in a standing configuration with at least one auxiliary brace extending from the wheelchair assembly, according to one or more embodiments shown and described herein.
Figure 8B:
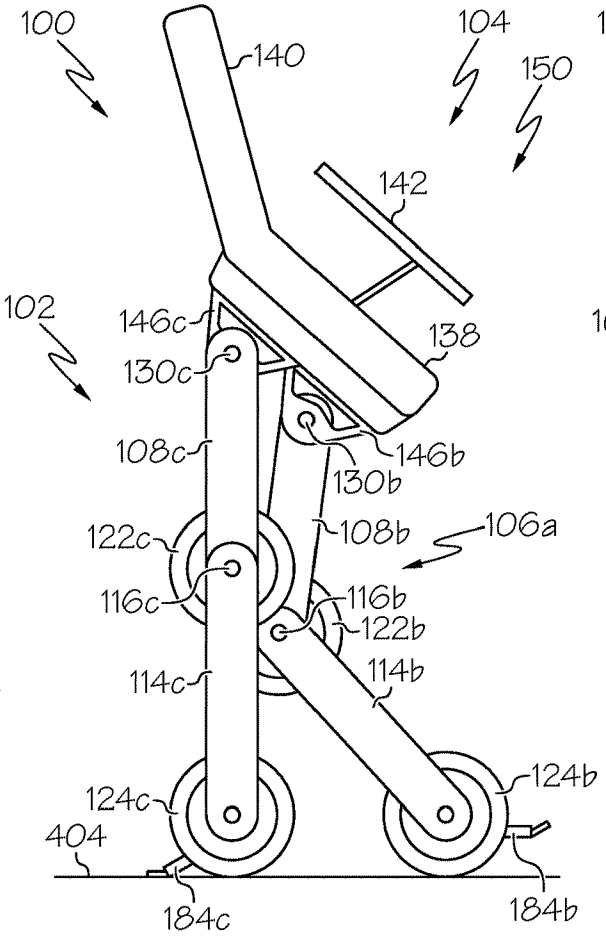
FIG. 8B depicts the wheelchair assembly in a seating-assist configuration, according to one or more embodiments shown and described herein.
Figure 8A:
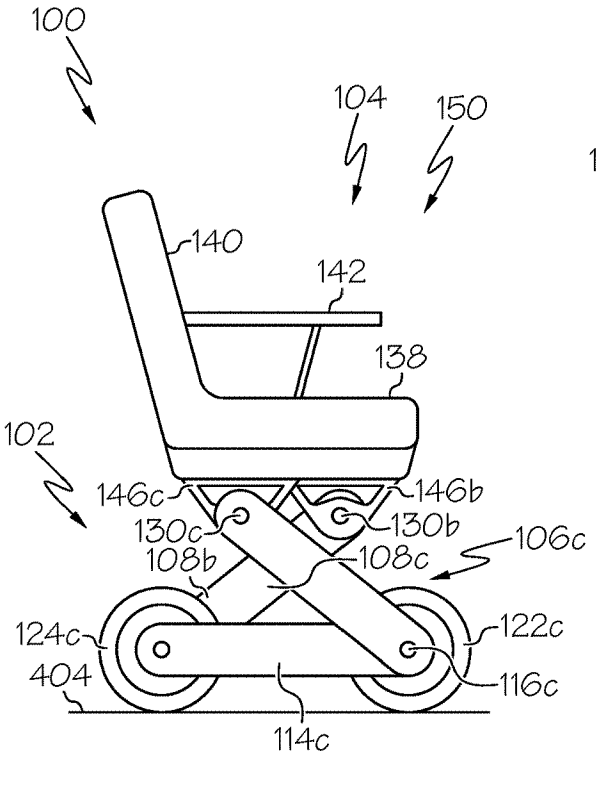
FIG. 8A depicts the wheelchair assembly in a retracted configuration, according to one or more embodiments shown and described herein.

Referring to FIGS. 8A-8C, the wheelchair assembly 100 is shown extending from a retracted configuration in FIG. 8A, to a seating-assist configuration in FIG. 8B, to a standing configuration in FIG. 8C. In the seating-assist configuration, leg modules 106*a* (illustrated in FIG. 2) and 106*c* are fully extended, while leg module 106*b* is bent at the knee joint 116*b*. This dips the front of the seat 138, allowing a user to more easily enter or exit the seat 138. The wheelchair assembly 100 can also fully extend each leg module 106 such that the seat 138 is at a maximum height. In certain configurations, an auxiliary brace may extend from one or more of the leg modules 106, to maintain the wheelchair assembly 100 in an upright position (i.e., with the seat portion 138 facing upward such that a user can maintain his or her balance in the seat with the wheelchair assembly 100 stopped). For example, a right auxiliary brace 184*c* and a middle auxiliary brace 184*b* are shown extended in FIG. 8C, but it is to be understood that the left leg module 106*a* may also include a left auxiliary brace (not shown). The auxiliary brace may include an elongate arm and a contact portion that contacts the support surface 404. The contact portion may be made from a resilient material (e.g., rubber) to restrict rolling motion of the wheels.

The auxiliary brace (e.g., auxiliary brace 184*b*, 184*c*) may move into position in coordination with the second wheel (e.g., second wheel 124*b*, 124*c*) to balance the wheelchair assembly 100. For example, the auxiliary braces 184*b*, 184*c* may extend and retract or may rotate in and out of contact with the support surface 404 or other ground upon which the wheelchair assembly 100 is positioned. The auxiliary braces 184*b*, 184*c* may extend to and contact a support surface 404 to add additional points of contact with the support surface 404, thereby bracing the wheelchair assembly 100 and reducing the amount of electrical energy necessary to power the leg modules 106 to keep the wheelchair assembly 100 upright. However, it is contemplated that the auxiliary brace may be extended in positions other than the upright position (e.g., the retracted configuration, the seating configuration, or any other positions). Accordingly, the auxiliary brace may be extended, for example, whenever the wheelchair assembly 100 is stationary. In some embodiments, the auxiliary brace may include a wheel at a contact end such that the auxiliary brace can be deployed while the wheelchair assembly 100 is moving. In some embodiments, the auxiliary brace may deploy automatically after the wheelchair assembly 100 has been stationary for a certain period of time (e.g., if the wheelchair assembly is stationary for 20 seconds, the auxiliary brace may automatically deploy). In some embodiments, the auxiliary brace may extend based on a user input or based on a particular battery charge level or battery use rate.

As one non-limiting example, the user may push a button on a user input device such as the user input module 222 of FIG. 2 to deploy the auxiliary braces 184*b*, 184*c*. The auxiliary braces 184*b*, 184*c* may then deploy (e.g., rotate, extend, etc.) into position such that it contacts the support surface 404 and increases the number of contact points between the wheelchair assembly 100 and the support surface, thereby increasing the balance of the wheelchair assembly 100. It is to be understood that the auxiliary braces 184*b*, 184*c* may be collectively or individually actuatable. In another example, the wheelchair assembly 100 may be configured to monitor the battery charge level and the battery use rate (e.g., using the power assembly 206 shown in FIG. 2). If it is determined that a battery use rate may reduce the battery charge level below a particular level before the battery can be charged again, the auxiliary braces 184*b*, 184*c* may be deployed such that the balance of the wheelchair assembly 100 is maintained with the wheelchair assembly in the upright position.

Figure 9B:
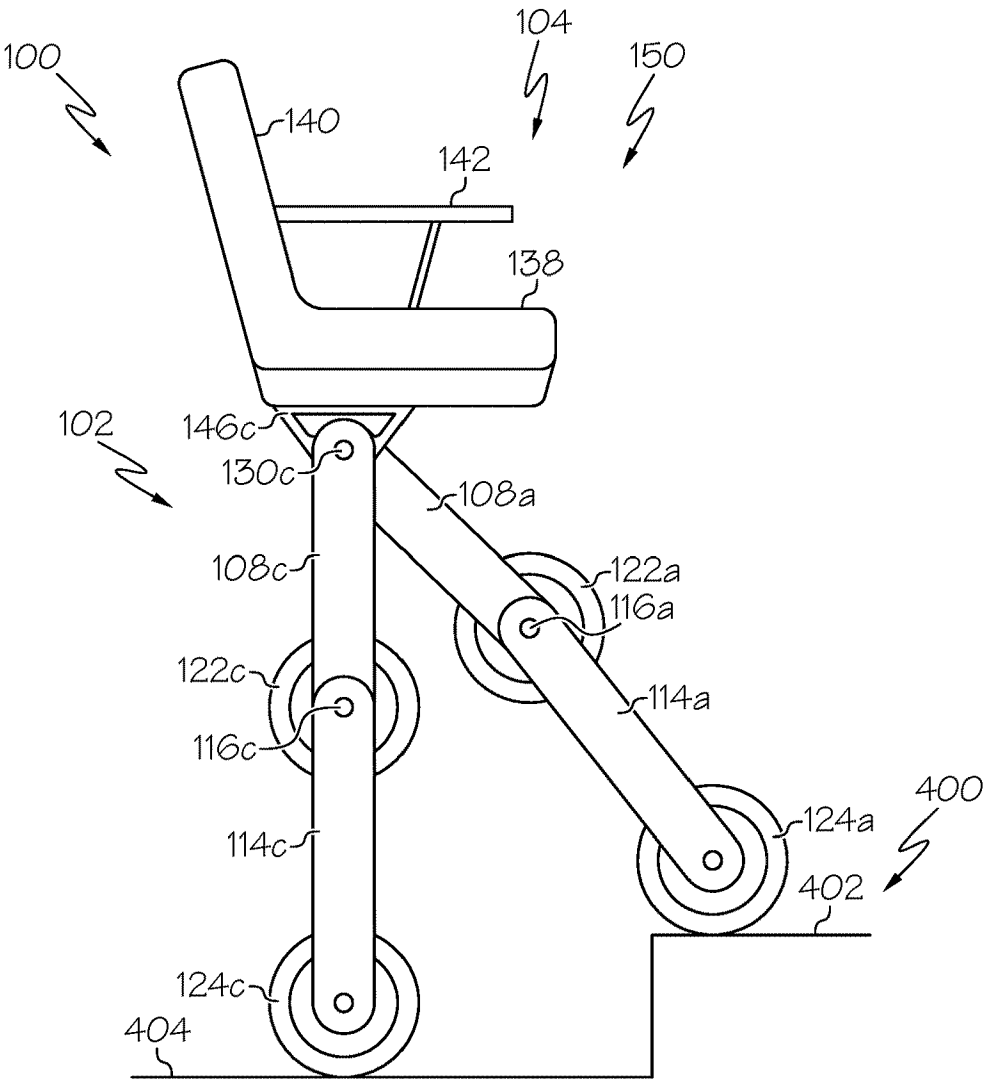
FIG. 9B depicts the wheelchair assembly in a bipedal configuration with one leg module extended over an obstacle, according to one or more embodiments shown and described herein.
Figure 9A:
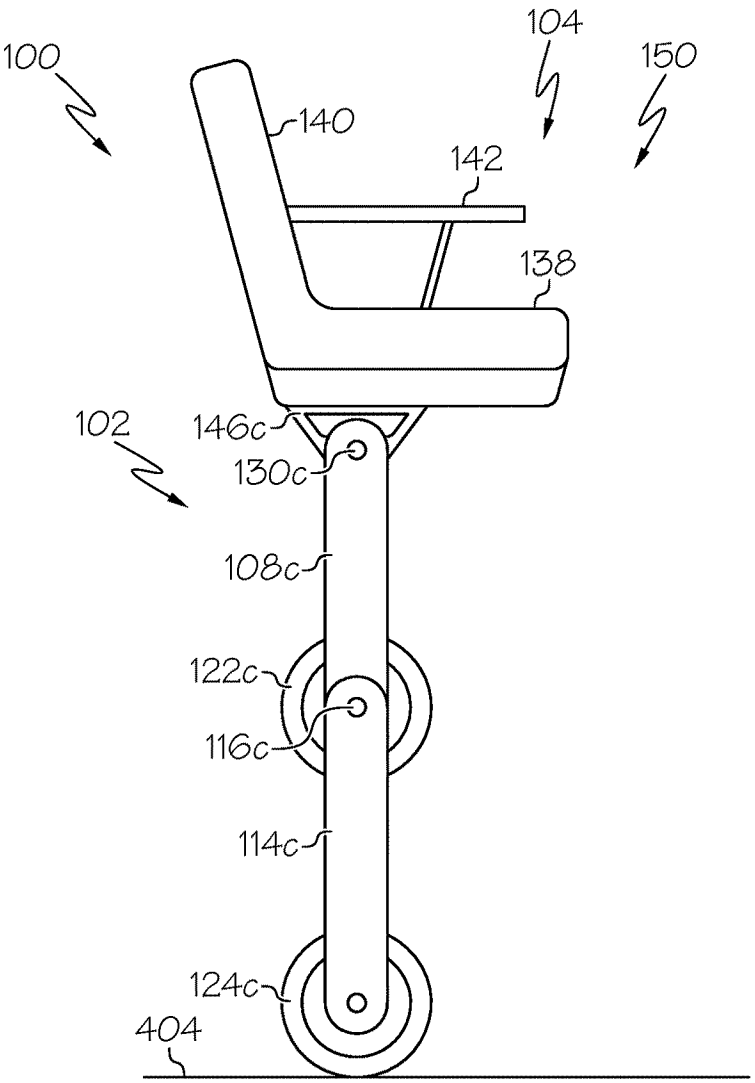
FIG. 9A depicts the wheelchair assembly in a bipedal configuration, according to one or more embodiments shown and described herein.

Referring to FIGS. 9A and 9B, a bipedal configuration of the wheelchair assembly 100 is shown. In the bipedal configuration, the wheelchair assembly 100 may balance on only two leg modules 106. The particular embodiment shown in FIGS. 9A and 9B includes a left leg module 106*a* and a right leg module 106*c*. As shown, the left leg module 106*a* may extend from the hip 130*a*. The second wheel 124*a* may extend atop the obstacle 400 while the right leg module 106*c* may remain in contact with the support surface 404 keeping the wheelchair assembly 100 balanced. The left leg module 106*a* may bend at the hip joint 130*a* and/or the knee joint 116*a* to move the second wheel 124*a* above the obstacle 400. As the left leg module 106*a* actuates and the second wheel 124*a* is lifted from the ground, the right leg module 106*c* may continue to balance the wheelchair assembly 100 upright on only one point of contact (i.e., right second wheel 124*c*). Once the left leg module 106*a* is supported on the obstacle, the weight of the wheelchair assembly 100 may shift from both the left and right leg modules 106*a*, 106*c* to only the left leg module 106*a* such that the wheelchair assembly 100 and the right leg module 106*c* may climb the obstacle while the wheelchair assembly 100 is supported by the left leg module 106*a* alone.

Figure 10C:
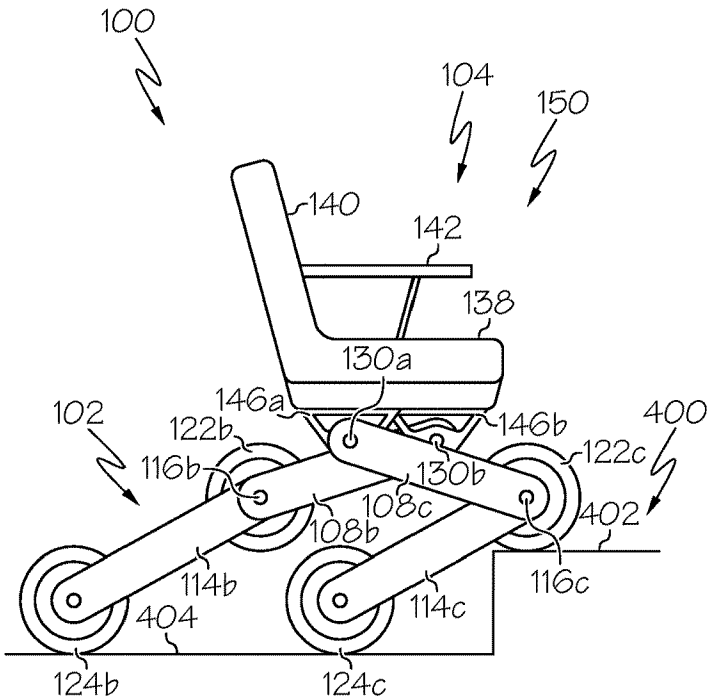
FIG. 10C depicts the wheelchair assembly climbing an obstacle, according to one or more embodiments shown and described herein.
Figure 10B:
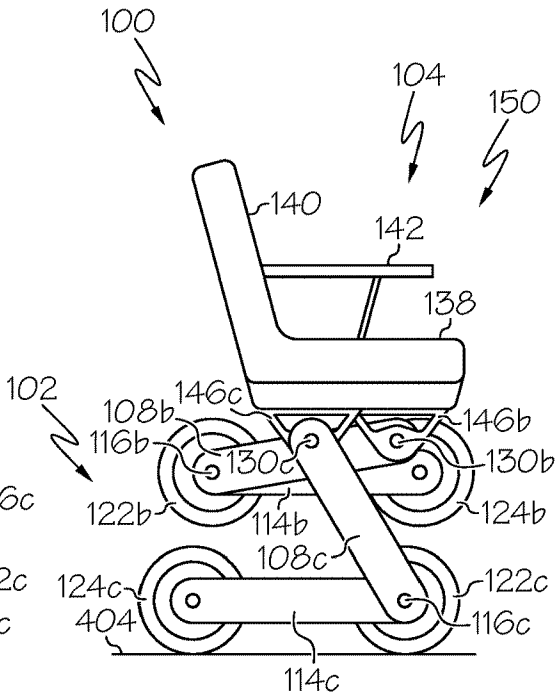
FIG. 10B depicts the wheelchair assembly approaching an obstacle with a middle leg module retracted upward, according to one or more embodiments shown and described herein.
Figure 10A:
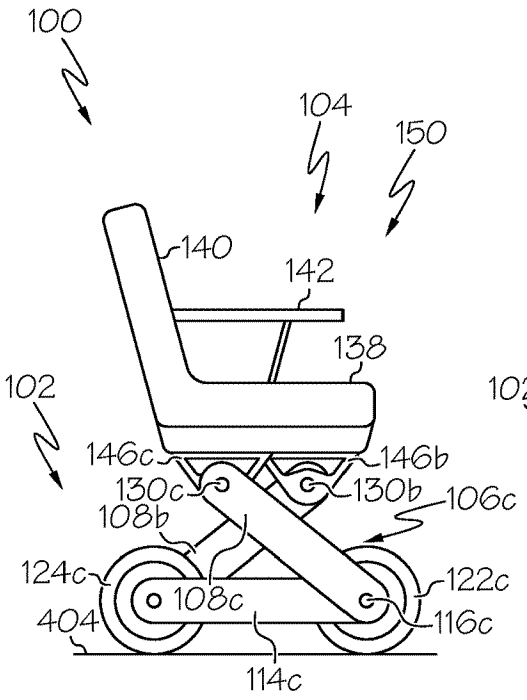
FIG. 10A depicts the wheelchair assembly in a retracted configuration, according to one or more embodiments shown and described herein.

Referring to FIGS. 10A-10C, another type of motion is shown. FIGS. 10A-10C show the wheelchair assembly 100 proceeding through a motion sequence to traverse an obstacle 400. In FIG. 10B, the middle leg module 106*b* actuates to raise the middle second wheel 124*b* above the obstacle 400. The wheelchair assembly 100 climbs the obstacle 400 and as it climbs, the middle leg module 106*b* extends backwards behind the wheelchair assembly 100 to maintain contact with the support surface 404. The right leg module 106*c* (and/or the left leg module, not shown) may climb the obstacle 400 and the middle leg module 106*b* may support the wheelchair assembly 100 to maintain the wheelchair assembly 100 in the upright position as it traverses the obstacle 400.

It should now be understood that wheelchair assemblies may include a modular power base including at least one leg module supporting and powering the wheelchair assembly. The leg module may be selectively attachable to the wheelchair assembly and adaptable for use in one or more systems and/or assemblies external to the wheelchair. The leg module may include at least one driven wheel and an electric motor configured to drive the driven wheel. The driven wheel may be used to power the wheelchair assembly and the systems and/or assemblies external to the wheelchair. One or more portions of the leg module may articulate with respect to a seat portion of the wheelchair assembly to selectively position the seat portion and/or to surmount environmental obstacles in a path of the wheelchair assembly. Accordingly, leg modules enhance versatility, usability, and applicability of wheelchair assemblies and associated systems.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A modular power base for a wheelchair, the modular power base comprising:

two or more leg modules, each leg module comprising:

an upper leg portion comprising a distal end and a proximal end, wherein the proximal end is configured to be detachably and rotatably coupled to a seat portion of the wheelchair;

a lower leg portion having a first end and a second end, the first end of the lower leg portion being rotatably coupled to the distal end of the upper leg portion;

a first wheel rotatably coupled to the distal end of the upper leg portion and to the first end of the lower leg portion;

a second wheel rotatably coupled to the second end of the lower leg portion; and an independent control and power system comprising a control unit operable to control motion of the leg module.

2. The modular power base of claim 1, wherein the independent control and power system of each leg module comprises:

an upper leg actuator communicatively coupled to the control unit configured to articulate the upper leg portion with respect to the seat portion of the wheelchair; and a lower leg actuator communicatively coupled to the control unit configured to articulate the lower leg portion with respect to the upper leg portion.

3. The modular power base of claim 2, wherein the independent control and power system of each leg module further comprises a sensor unit comprising one or more sensors configured to output a signal indicative of at least one of an environmental condition and a posture of each leg module.

4. The modular power base of claim 3, wherein the control unit adjusts the posture of each leg module based on the signal received from the sensor unit.

5. The modular power base of claim 1, wherein at least one of the first wheel and the second wheel includes an auxiliary brace configured to extend and retract to maintain the wheelchair assembly in an upright position.

6. The modular power base of claim 1, wherein each leg module is operable via the independent control and power system independent of connection to the wheelchair.

7. The modular power base of claim 1, wherein each leg module is configured to attach to and power one or more systems or assemblies external to the wheelchair.

8. The modular power base of claim 1, wherein each independent control and power system further comprises a network interface hardware configured to communicatively couple the independent control and power system to one or more external systems.

9. The modular power base of claim 1, wherein each leg module further comprises a battery configured to power the leg module when the leg module is disconnected from the wheelchair.

10. A wheelchair assembly comprising:

a seat portion; and two or more leg modules detachably coupled to the seat portion, wherein each leg module comprises:

an upper leg portion comprising a distal end and a proximal end, wherein the proximal end is configured to be detachably and rotatably coupled to the seat portion;

a lower leg portion having a first end and a second end, the first end of the lower leg portion being rotatably coupled to the distal end of the upper leg portion;

a first wheel rotatably coupled to the distal end of the upper leg portion and to the first end of the lower leg portion;

a second wheel rotatably coupled to the second end of the lower leg portion; and an independent control and power system comprising a control unit operable to control motion of the leg module.

11. The wheelchair assembly of claim 10, wherein the independent control and power system of each leg module comprises:

an upper leg actuator communicatively coupled to the control unit configured to articulate the upper leg portion with respect to the seat portion; and a lower leg actuator communicatively coupled to the control unit configured to articulate the lower leg portion with respect to the upper leg portion.

12. The wheelchair assembly of claim 11, wherein the independent control and power system of each leg module further comprises a sensor unit comprising one or more sensors configured to output a signal indicative of at least one of an environmental condition or a posture of each leg module.

13. The wheelchair assembly of claim 12, wherein the control unit adjusts the posture of each leg module based on the signal received from the sensor unit.

14. The wheelchair assembly of claim 11, wherein at least one of the first wheel and the second wheel is motorized and controllable by the control unit.

15. The wheelchair assembly of claim 10 further comprising one or more frame members coupled to a bottom surface of the seat portion and coupled to each leg module.

16. A wheelchair assembly comprising:

a seat portion;

a first leg module detachably coupled to the seat portion; and a second leg module detachably coupled to the seat portion, wherein:

each of the first leg module and the second leg module comprises:

an upper leg portion comprising a distal end and a proximal end, wherein the proximal end is configured to detachably and rotatably couple to the seat portion;

a lower leg portion having a first end and a second end, the first end of the lower leg portion being rotatably coupled to the distal end of the upper leg portion;

a first wheel rotatably coupled to the distal end of the upper leg portion and to the first end of the lower leg portion;

a second wheel rotatably coupled to the second end of the lower leg portion; and an independent control and power system comprising a control unit operable to control motion of the leg module.

17. The wheelchair assembly of claim 16, wherein the independent control and power system of each of the first leg module and the second leg module comprises:

an upper leg actuator communicatively coupled to the control unit configured to articulate the upper leg portion with respect to the seat portion; and a lower leg actuator communicatively coupled to the control unit configured to articulate the lower leg portion with respect to the upper leg portion.

18. The wheelchair assembly of claim 17, wherein the independent control and power system of each of the first leg module and the second leg module further comprises a sensor unit comprising one or more sensors configured to output a signal indicative of at least one of an environmental condition or a posture of at least one of the first leg module and the second leg module.

19. The wheelchair assembly of claim 18, wherein the control unit adjusts the posture of the first leg module and the second leg module based on the signal from the sensor unit.

20. The wheelchair assembly of claim 17, wherein at least one of the first wheel and the second wheel of at least one of the first leg module and the second leg module is motorized and controllable by the control unit.

21. The wheelchair assembly of claim 20 further comprising:

a first frame member coupled to a bottom surface of the seat portion and coupled to the first leg module; and a second frame member coupled to the bottom surface of the seat portion and coupled to the second leg module.

* * * * *